US010283863B2

(12) United States Patent
Ohno et al.

(10) Patent No.: US 10,283,863 B2
(45) Date of Patent: May 7, 2019

(54) COMPOSITE ANTENNA AND METHOD OF PRODUCING THE SAME

(71) Applicant: YOKOWO CO., LTD., Kita-ku, Tokyo (JP)

(72) Inventors: Sadao Ohno, Tomioka (JP); Kengo Osawa, Tomioka (JP); Takashi Nozaki, Tomioka (JP); Kenichi Tanaka, Tomioka (JP)

(73) Assignee: YOKOWO CO., LTD., Tokyo (JP)

( * ) Notice: Subject to any disclaimer, the term of this patent is extended or adjusted under 35 U.S.C. 154(b) by 290 days.

(21) Appl. No.: 15/504,471

(22) PCT Filed: Jul. 13, 2015

(86) PCT No.: PCT/JP2015/070043

§ 371 (c)(1),
(2) Date: Feb. 16, 2017

(87) PCT Pub. No.: WO2016/027591

PCT Pub. Date: Feb. 25, 2016

(65) Prior Publication Data

US 2017/0237167 A1 Aug. 17, 2017

(30) Foreign Application Priority Data

Aug. 9, 2014 (JP) ..... 2014-166625

(51) Int. Cl.
*H01Q 5/321* (2015.01)
*H01Q 9/40* (2006.01)
(Continued)

(52) U.S. Cl.
CPC ..... *H01Q 5/321* (2015.01); *H01Q 1/241* (2013.01); *H01Q 1/325* (2013.01); *H01Q 1/525* (2013.01);
(Continued)

(58) Field of Classification Search
CPC ..... H01Q 9/40; H01Q 5/321; H01Q 1/241; H01Q 5/371; H01Q 1/525; H01Q 9/32; H01Q 1/325; H01Q 7/00
See application file for complete search history.

(56) References Cited

U.S. PATENT DOCUMENTS 4,222,053 A * 9/1980 Newcomb ..... H01Q 9/145 343/722
7,023,388 B2 * 4/2006 Shimabara ..... H01Q 1/242 343/702
(Continued)

FOREIGN PATENT DOCUMENTS

JP 2000-252733 A 9/2000
JP 2003-324305 A 11/2003
(Continued)

OTHER PUBLICATIONS

International Search Report dated Sep. 29, 2015, for corresponding International Patent Application No. PCT/JP2015/070043.

*Primary Examiner* — Jessica Han
*Assistant Examiner* — Jae K Kim
(74) *Attorney, Agent, or Firm* — Morgan, Lewis & Bockius LLP

(57) ABSTRACT

A composite antenna includes: a coil element which is formed into a spiral shape, and which has a trap coil portion in a base end portion; a tubular conductive element which is electrically series-connected to a base end of the coil element; and a connection metal fitting which is electrically connected to a base end of the conductive element. A series connection of the coil element and the tubular conductive element operates in a first frequency band, and the tubular conductive element alone operates in a second frequency band which is higher than the first frequency band.

7 Claims, 6 Drawing Sheets

(51) Int. Cl.

| | |
|---|---|
| ***H01Q 1/24*** | (2006.01) |
| ***H01Q 1/32*** | (2006.01) |
| ***H01Q 1/52*** | (2006.01) |
| ***H01Q 9/32*** | (2006.01) |
| ***H01Q 5/371*** | (2015.01) |
| *H01Q 7/00* | (2006.01) |

(52) U.S. Cl.
CPC ..... *H01Q 5/371* (2015.01); *H01Q 9/32* (2013.01); *H01Q 9/40* (2013.01); *H01Q 7/00* (2013.01)

(56) References Cited

U.S. PATENT DOCUMENTS

| | | | | |
|---|---|---|---|---|
| 9,786,990 | B2 * | 10/2017 | Platt | H01Q 1/38 |
| 2003/0137463 | A1 | 7/2003 | Shimizu | |
| 2010/0013723 | A1 | 1/2010 | Platt et al. | |
| 2011/0193755 | A1 * | 8/2011 | Lindenmeier | H01Q 1/3275 343/715 |
| 2013/0069835 | A1 * | 3/2013 | Swais | H01Q 1/3275 343/715 |
| 2014/0111397 | A1 * | 4/2014 | Lim | H01Q 1/362 343/826 |
| 2014/0125552 | A1 * | 5/2014 | Takisawa | H01Q 1/362 343/895 |

FOREIGN PATENT DOCUMENTS

| | | | |
|---|---|---|---|
| JP | 2009-272971 | A | 11/2009 |
| WO | 02/069444 | A1 | 9/2002 |

* cited by examiner

COMPOSITE ANTENNA AND METHOD OF PRODUCING THE SAME

TECHNICAL FIELD

The present invention relates to a composite antenna which has an antenna element that operates in a first frequency band for reception of AM/FM signals or the like, and another antenna element that, in order to, for example, transmit and receive data, operates in a second frequency band that is higher than the first frequency band, and which is to be used in a vehicle antenna or the like, and also to a method of producing the same.

BACKGROUND ART

As a conventional vehicle antenna, a structure disclosed in Patent Literature 1 below is known. In this case, in a state where a conductive connection metal fitting is electrically and mechanically connected to a conductive coil functioning as an antenna element, the outer circumference of the coil is placed so as to be in contact with the inner surface of a first molding die, and resin molding is then performed in a state where the coil is exposed from the surface. Therefore, the pitch of the coil is fixed by a resin, and the coil is configured as an antenna element which resonates at a required frequency. Moreover, a cover shape of the outer circumference of the antenna element is resin-molded by using a second molding die. The connection metal fitting is connected to an antenna base. The vehicle antenna in Patent Literature 1 corresponds to a specific frequency band which is defined by the one antenna element, and is used for receiving, for example, FM/AM broadcasts.

Recently, a vehicle antenna is requested to comply with a frequency band for transmitting and receiving data of a mobile phone for a broadband such as the LTE (hereinafter, referred to as "TEL band"), in addition to a frequency band for receiving FM/AM broadcasts. Therefore, a composite antenna such as disclosed in Patent Literature 2 below is proposed. The composite antenna has a structure in which an AM/FM antenna element and another high frequency antenna element are combined with each other so as to produce less distortion. That is, a second antenna element for a second frequency band which is used as the TEL band is placed so as to be passed through the inside of a helical coil which serves as a first antenna element that operates in a first frequency band for reception of AM/FM broadcasts, whereby antenna composition is attained.

CITATION LIST

Patent Literature

Patent Literature 1: JP-A-2000-252733
Patent Literature 2: JP-A-2009-272971

SUMMARY OF INVENTION

Technical Problem

When the range of the used second frequency band is to be broadened, the second antenna element must be thickened as far as possible. In the configuration of Patent Literature 2, however, the thin second antenna element is passed through the helical coil. When the second antenna element is to be thickened, therefore, the outer diameter of the helical coil must be increased. Consequently, there is a problem in that also the diameter of the exterior of the composite antenna is increased.

The present invention has been conducted in view of such circumstances. It is an object of the present invention to provide a composite antenna which can be used in a plurality of frequency bands without increasing a diameter dimension of an antenna exterior as compared with a conventional AM/FM antenna, and also a method of producing the antenna.

Solution to Problem

A first aspect of the present invention is a composite antenna. The composite antenna includes: a coil element which is formed into a spiral shape, and which has a trap coil portion in a base end portion;

- a tubular conductive element which is electrically series-connected to a base end of the coil element; and
- a connection metal fitting which is electrically connected to a base end of the conductive element, wherein
- a series connection of the coil element and the tubular conductive element operates in a first frequency band, and the tubular conductive element alone operates in a second frequency band which is higher than the first frequency band.

In the first aspect, the composite antenna may further include an insulative core member which is placed inside the conductive element, and which has a spiral groove in a tip end side that projects from the conductive element, and the trap coil portion may be engaged with the spiral groove to hold a pitch of the trap coil portion constant.

In the first aspect, the composite antenna may further include: an inner resin molded portion which holds the coil element and the conductive element; and an outer resin molded portion which is softer than the inner resin molded portion, and which covers an outside of the inner resin molded portion.

In a case where a hole portion which passes through a tip end portion of the outer resin molded portion to reach a predetermined depth of a tip end portion of the inner resin molded portion is formed, a cap may be fitted to the hole portion.

A cutout portion may be formed in the base end portion of the conductive element, and a thick portion which circles in a strip-like manner an outside of the base end portion of the conductive element may be formed on the inner resin molded portion.

A through hole may be formed in an outer circumferential surface of the conductive element, and the inner resin molded portion may pass through the through hole.

In the first aspect, the composite antenna may further include an insulative core member which is placed inside the conductive element, and which projects from the conductive element, the coil element may be adhered to an outer circumference of the insulative core member, and the coil element and the conductive element may be covered by an outer insulator.

A second aspect of the present invention is a method of producing a composite antenna. The method of producing the composite antenna includes electrically connecting a tubular conductive element to a base end of a coil element which is formed into a spiral shape, and which has a trap coil portion in a base end portion;

- attaching an attachment portion of an insulative core member which has a spiral groove, to a connection metal fitting, and causing the insulative core member to pass through an inside of the conductive element to project, thereby electrically connecting the connection metal fitting to a base end of the conductive element; and forming a resin molded portion by insert-molding in a state where the trap coil portion is engaged with the spiral groove of the insulative core member which projects from the conductive element.

Arbitrary combinations of the above-described components, and expressions of the present invention which are converted in method, system, or the like are also effective as aspects of the present invention.

Advantageous Effects of Invention

According to the present invention, the coil element which is formed into a spiral shape, and which has a trap coil portion in a base end portion, and the tubular conductive element which is electrically series-connected to the base end of the coil element are used, and setting is performed so that the series connection of the coil element and the tubular conductive element operates in the first frequency band, and the tubular conductive element alone operates in the second frequency band which is higher than the first frequency band, whereby a composite antenna can be realized which can be used in a plurality of frequency bands without increasing the diameter dimension of the antenna exterior as compared with a conventional AM/FM antenna.

BRIEF DESCRIPTION OF DRAWINGS

FIG. 2(A) is a side view of a state where, in a first molding step, an inner resin molded portion that covers a coil element and a conductive element is insert-molded, FIG. 2(B) is a side sectional view of the state, FIG. 2(C) is a side view of a completed state in which an outer resin molded portion that covers the outside of the inner resin molded portion is insert-molded, and FIG. 2(D) is a side sectional view of the state.

FIG. 7(A) is a perspective view of a state where, in the first molding step, the inner resin molded portion that covers the coil element and the conductive element is insert-molded, FIG. 7(B) is a perspective view of the outer resin molded portion that covers the outside of the inner resin molded portion, and FIG. 7(C) is an exploded perspective view showing a structure where a hole portion which passes through a tip end portion of the outer resin molded portion to reach a predetermined depth of a tip end portion of the inner resin molded portion is closed by a cap.

DESCRIPTION OF EMBODIMENTS

Figure 1:
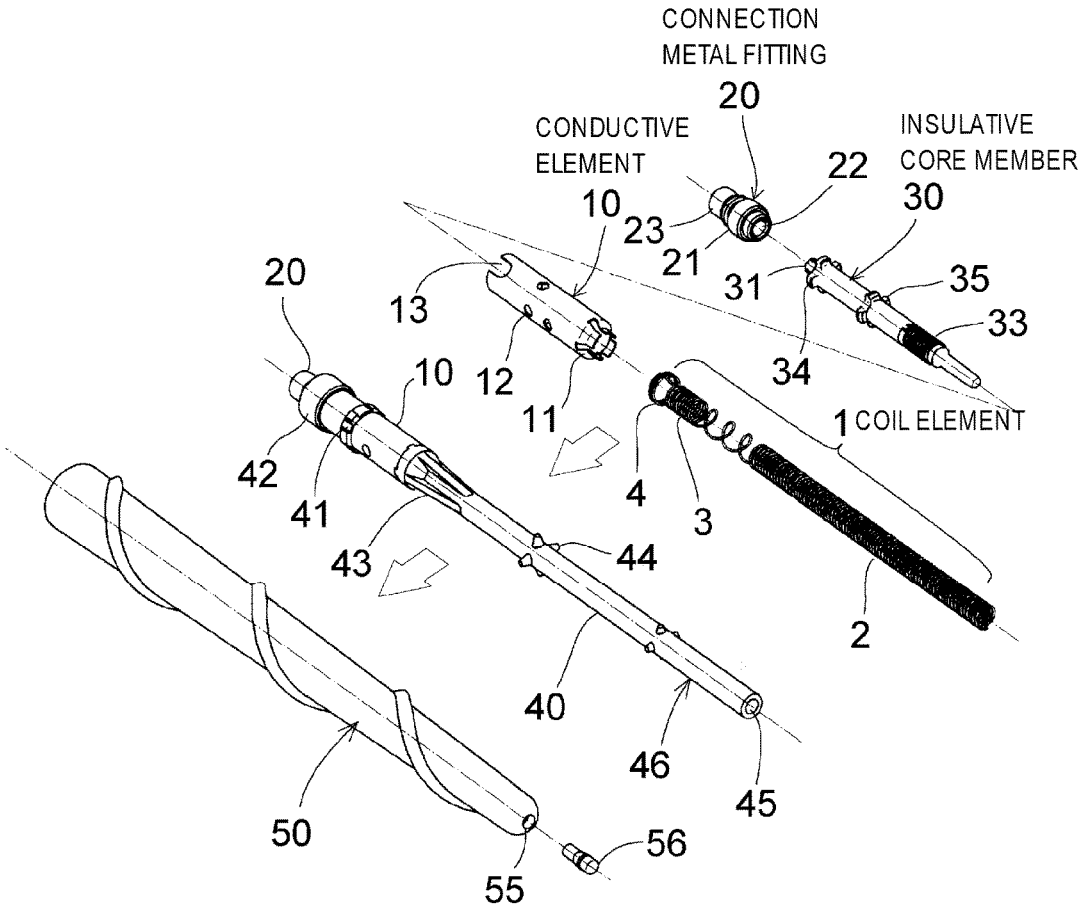
FIG. 1 is an exploded perspective view showing Embodiment 1 of the composite antenna of the invention, and the method of producing the same.

Hereinafter, preferred embodiments of the present invention will be described in detail with reference to the drawings. Identical or equivalent components, members, processes, and the like shown in the drawings are denoted by the same reference numerals, and duplicated descriptions are appropriately omitted. The embodiments do not limit the invention, but only exemplify the invention, and all features described in the embodiments, and their combinations are not necessarily essential in the invention.

Embodiment 1

Embodiment 1 regarding the composite antenna and the method of producing the same according to the present invention will be described with reference to FIGS. 1 to 7(C). The composite antenna is used in a vehicle application or the like, and as a whole has an external shape of a pole antenna. As shown in FIGS. 1 to 2(D), the composite antenna includes: a coil element 1 (functioning as a first antenna element) which is formed into a spiral shape, and which has a trap coil portion 3 in a base end portion; a cylindrical conductive element 10 (functioning as a second antenna element) which is electrically series-connected to the base end of the coil element 1; a connection metal fitting 20 which is electrically connected to the base end of the cylindrical conductive element 10; and an insulative core member (antenna core) 30 which is placed inside the conductive element 10, and in which a tip end side projects from the conductive element 10. A series connection of the coil element 1 and the cylindrical conductive element 10 operates in a frequency band for AM/FM broadcasts which serves as a first frequency band, and the cylindrical conductive element 10 alone operates in a TEL band which serves as a second frequency band that is higher than the frequency band for AM/FM broadcasts.

Figure 3:
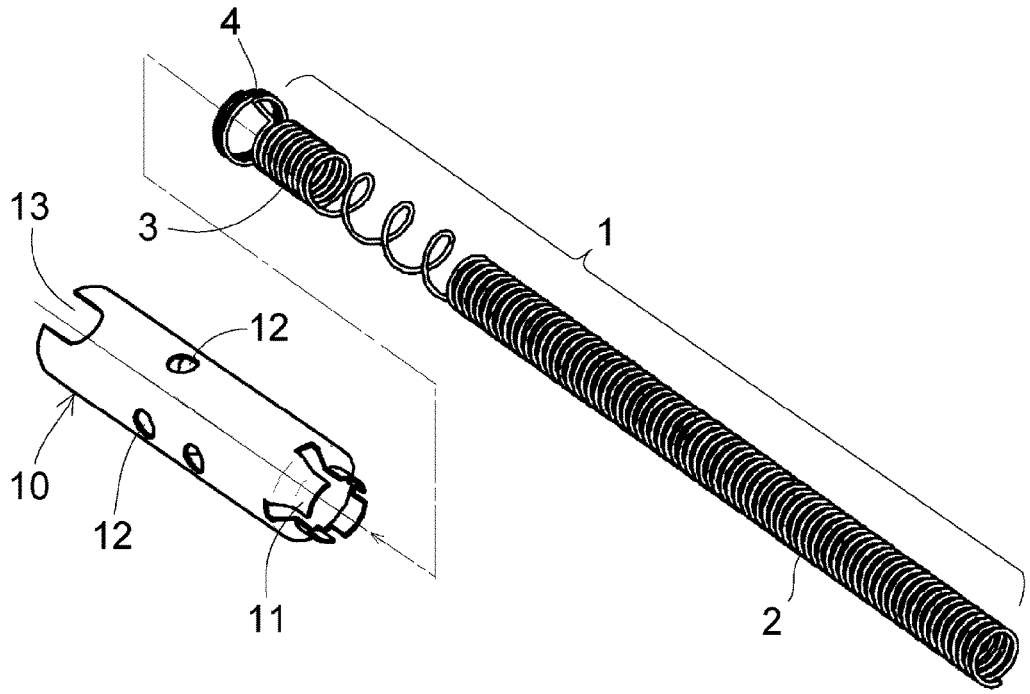
FIG. 3 is an exploded perspective view showing the coil element and conductive element in Embodiment 1.

In the coil element 1, as shown in FIG. 3, the whole is spirally wound, and, in the sequence starting from the tip end, a helical coil portion 2 for reception of AM/FM broadcasts, the trap coil portion 3, and a connecting portion 4 in which the winding is closely wound are formed. The trap coil portion 3 is wound at a small pitch. The helical coil portion 2 is wound at a pitch which is slightly larger than the pitch of the trap coil portion 3, and, particularly in the base end side of the helical coil portion 2, the winding is formed at a large pitch. The connecting portion 4 which is located on a side of the base end with respect to the trap coil portion 3, and in which the winding is wound at a small pitch is formed so as to be fitted onto the outside of a coil attaching portion 11 which will be a small-diameter portion of the cylindrical conductive element 10. The coil element 1 is configured by, for example, a stainless steel wire having an excellent corrosion resistance.

The cylindrical conductive element 10 is formed by rolling a metal plate (conductor plate) such as an iron plate. As shown in FIG. 3, the tip end side is formed as the coil attaching portion 11 in which the outer diameter is reduced in order to attach the connecting portion 4 of the coil element 1. The connecting portion 4 of the coil element 1 rides on (is fitted onto) the outside of the coil attaching portion 11 of the conductive element 10 to be fixed thereto. The electric connection and fixation between the connecting portion 4 and the coil attaching portion 11 are performed by, for example, welding.

A space through which the insulative core member 30 passes while rotating is disposed inside the cylindrical conductive element 10, and set so that the insulative core member 30 can be fixed by screwing the insulative core member 30 into the coil element 1.

Moreover, the coil attaching portion 11 in which the outer diameter is narrow, and which is on the tip end side of the conductive element 10 is divided by gaps into a plurality of pieces (in the illustrated case, four pieces). In a first molding step which is performed for disposing an inner resin molded portion 40 shown in FIGS. 2(A) and 2(B), and which will be described later, a resin in a molten state will flow through the gaps into the inside of the conductive element 10. Moreover, a plurality of through holes 12 are formed in the outer circumferential surface of the conductive element 10, and the resin in a molten state which flows into the inside of the conductive element 10 in the first molding step will pass through the through holes 12 to project to the outside and form projections 41 due to the inner resin molded portion 40. In a second molding step which is performed for disposing an outer resin molded portion 50 shown in FIGS. 2(C) and 2(D), and which will be described later, the projections 41 function as projections for preventing the inner resin molded portion 40 from slipping off and rotating.

Figure 5:
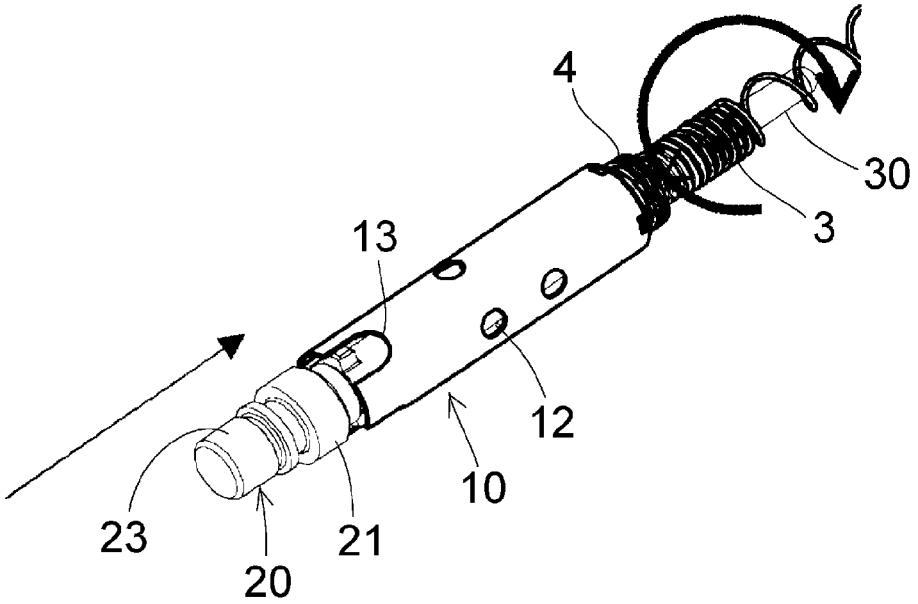
FIG. 5 is a perspective view showing a state where, after the conductive element is welded to the base end of the coil element, the insulative core member which is provisionally fixed to the connection metal fitting is caused to pass through the inside of the conductive element to project, and a spiral groove of the insulative core member is screwed into a trap coil portion of the coil element to be screwed to the trap coil portion.
Figure 6:
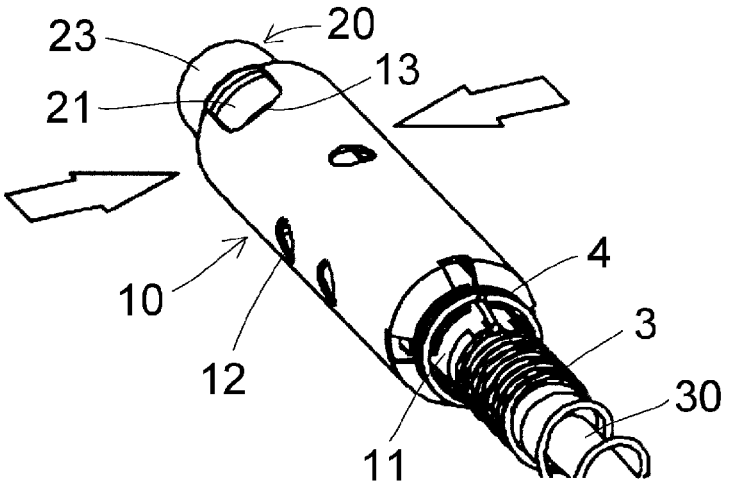
FIG. 6 is a perspective view showing a step of resistance-welding the connection metal fitting to the conductive element.

As shown in FIGS. 5 and 6, in the base end side of the cylindrical conductive element 10, a cutout portion 13 which is to be used in welding (for example, resistance-welded) with the connection metal fitting 20 is formed so as not to be at a directly opposite position with respect to the center axis of the cylindrical conductive element 10, and the conductive element 10 and the connection metal fitting 20 are enabled to be vertically clamped by welding electrodes of a resistance welder. That is, one of welding electrodes of a resistance welder is enabled to be contacted with the conductive element 10, and the other welding electrode is enabled to be contacted with the connection metal fitting 20 which is exposed from the cutout portion 13, so that the welding conditions can be easily stabilized.

Figure 4:
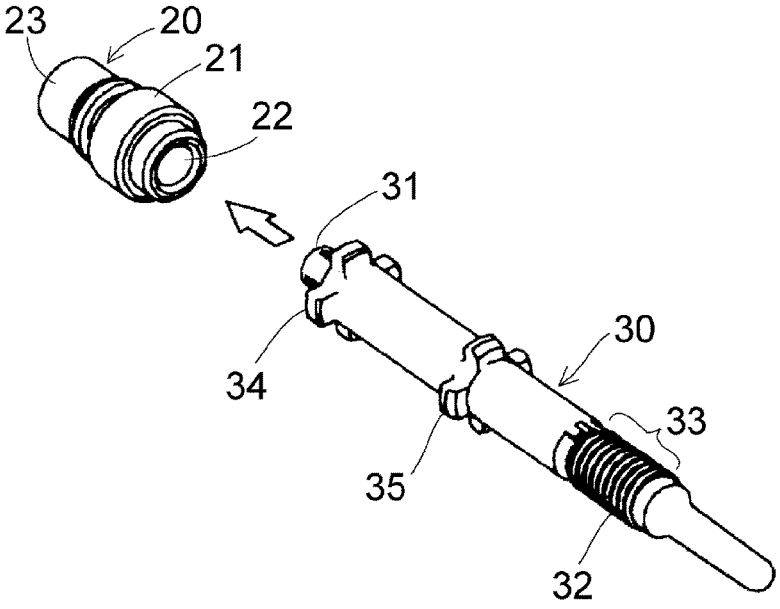
FIG. 4 is an exploded perspective view showing an insulative core member and connection metal fitting in Embodiment 1.

As shown in FIGS. 4 and 5, a large-diameter connecting portion 21 is formed in the vicinity of the middle of the connection metal fitting 20, and its diameter is formed to be approximately equal to the inner diameter of the cylindrical conductive element 10 so that the large-diameter connecting portion 21 can be fitted into the inside of the conductive element 10. A press insertion hole 22 into which an attachment portion 31 of the insulative core member 30 is to be press-inserted is formed in a tip end surface. The basal end side of the connection metal fitting 20 is formed as a male thread portion 23 for attachment to an attachment base.

In the insulative core member 30, as shown in FIG. 4, an attachment portion 31 which is to be press-inserted into the press insertion hole 22 of the connection metal fitting 20 is formed in the base end side, and a screwing portion 33 having a spiral groove 32 in which the pitch is equal to the pitch of the trap coil portion 3 is formed in the tip end side. In a state where the insulative core member 30 in which the attachment portion 31 in the base end side is press-inserted into the connection metal fitting 20 is placed inside the cylindrical conductive element 10, the screwing portion 33 projects from an opening of the tip end side of the conductive element 10. In the insulative core member 30, in each of the base end side and the vicinity of the middle, projections 34 or 35 which project in the outer circumferential direction are formed circumferentially at regular intervals in a plurality of places (in the illustrated case, four places). Theses projections 34, 35 function as spacers for forming a gap with respect to the inner surface of the cylindrical conductive element 10, so that, in the first molding step, a molten resin which is to be formed as the inner resin molded portion 40 can flow into the gap.

Next, the procedure of assembling the members and the first and second molding steps will be described. First, the connecting portion 4 of the coil element 1 is fitted to the outside of the coil attaching portion 11 of the cylindrical conductive element 10 shown in FIG. 3, and the electric connection and fixation between the connecting portion 4 and the coil attaching portion 11 are performed by welding or the like. Aside from this, as shown in FIG. 4, the attachment portion 31 of the insulative core member 30 is inserted (press-inserted) into the press insertion hole 22 of the connection metal fitting 20, and the insulative core member 30 is provisionally held by the connection metal fitting 20.

As shown in FIG. 5, the insulative core member 30 to which the connection metal fitting 20 is attached is rotated in the direction of the arrow to be inserted while being screwed, into the inside of the cylindrical conductive element 10, thereby screwing the screwing portion 33 having the spiral groove 32 into the trap coil portion 3. As a result, the wire member of the trap coil portion 3 is engaged with the spiral groove 32, and held so that the spiral pitch is not changed.

As shown in FIG. 6, then, the connecting portion 21 of the connection metal fitting 20 is resistance-welded to the cylindrical conductive element 10. In this case, when the cutout portion 13 is formed in the base end of the cylindrical conductive element 10, one of welding electrodes of a resistance welder can be contacted with the conductive element 10, the other welding electrode can be contacted with the connecting portion 21 of the connection metal fitting 20 which is exposed from the cutout portion 13, and stable welding is enabled.

Figure 2A:
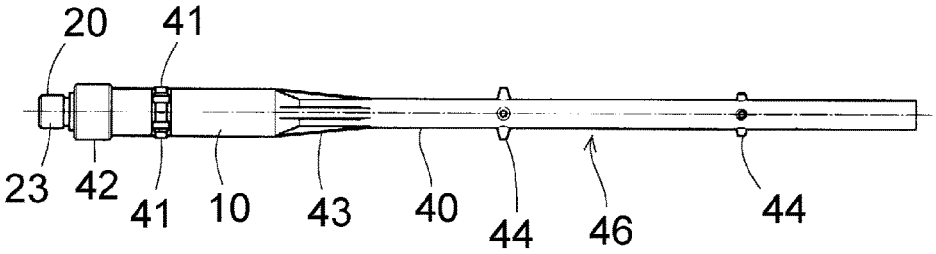
FIGS. 2(A) to 2(D) illustrate steps of producing Embodiment 1.
Figure 2B:
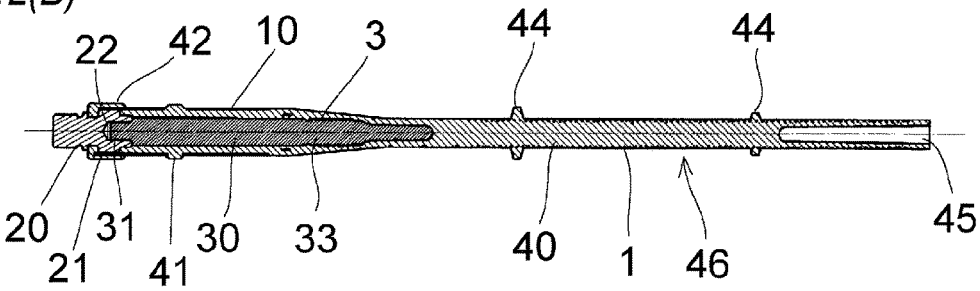
Figure 7A:
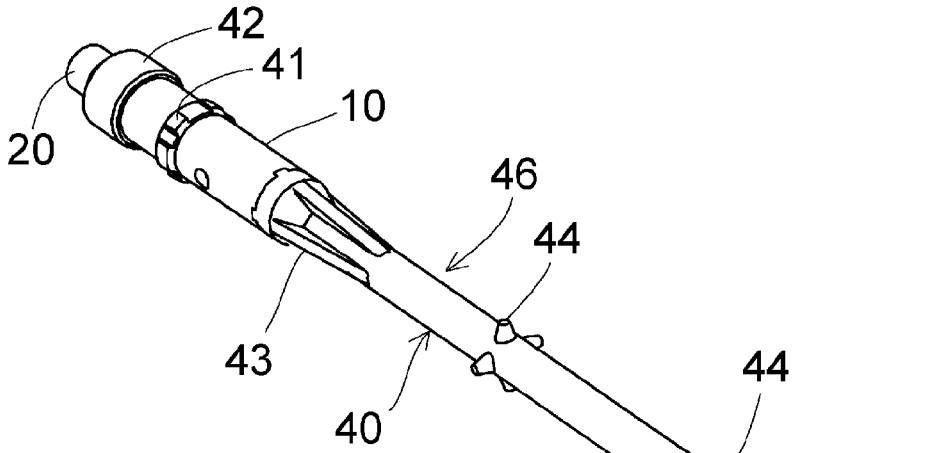
FIGS. 7(A) to 7(C) show Embodiment 1.

Next, the inner resin molded portion 40 which is shown in FIGS. 2(A), 2(B), and 7(A), and which holds the coil element 1 and the cylindrical conductive element 10 is formed in the first molding step. That is, a molten resin is poured into a molding space of a first resin molding die to perform the insert molding in a state where a structure in which the coil element 1, the cylindrical conductive element 10, the connection metal fitting 20, and the insulative core member 30 are integrated with one another is placed in the molding space of the first molding die (however, the base end side of the connection metal fitting 20 is outside the molding space), and the base end of the connection metal fitting 20 and the inside of a tip end portion of the coil element 1 are supported by the first resin molding die.

The inner resin molded portion 40 which is formed in the first molding step covers the coil element 1, partially covers the outer circumferential surface of the cylindrical conductive element 10, and has: the plurality of projections 41 which outwardly project from the through holes 12 of the cylindrical conductive element 10; a thick portion 42 which circles in a strip-like manner the outside of the base end portion of the cylindrical conductive element 10; a plurality of reinforcement ribs 43 that are formed in a portion in which the outer diameter is further reduced as more advancing from the outer circumference of the conductive element 10 toward the outer circumference of the coil element 1; a plurality of projections 44 which are disposed on the outer circumference of the coil element 1; and a columnar recess portion 45 which opens in the tip end surface. The projections 41 and 44 function as members for preventing from slipping off and rotating with respect to the outer resin molded portion 50 which is formed in the second molding step that will be described later. Moreover, the strip-like thick portion 42 is used as a reinforcement for compensating strength reduction in the case where the cutout portion 13 is formed in the cylindrical conductive element 10. The columnar recess portion 45 is in a place where a positioning pin for supporting the inside of the tip end portion of the coil element 1 was inserted in the molding process.

The outer circumferential portion of the coil element 1 is resin-molded in the state where it is held by the first resin molding die, and fixed by the inner resin molded portion 40 without causing short circuit between the pitches. In order to withstand repeated bendings of the antenna, the insulative core member 30 is configured by a material (resin) which is equal to or lower than the inner resin molded portion 40 in melting point, and enabled to be firmly adhered to the inner resin molded portion 40 by the insert-molding.

Figure 2C:
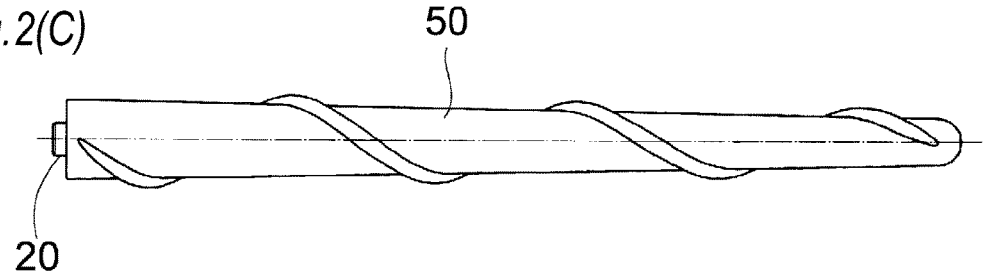
Figure 2D:
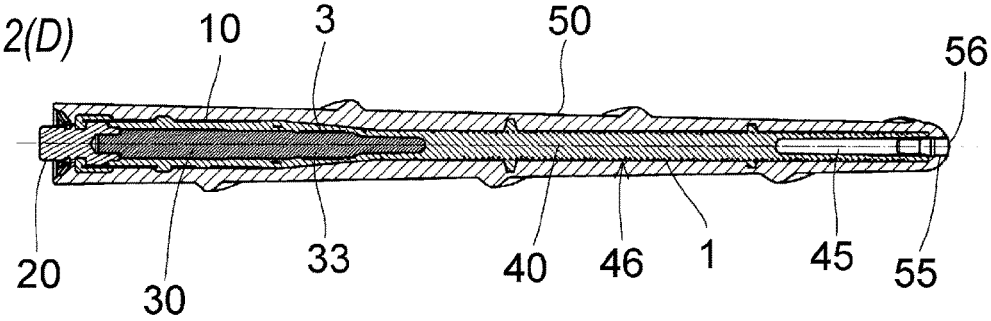
Figure 7B:
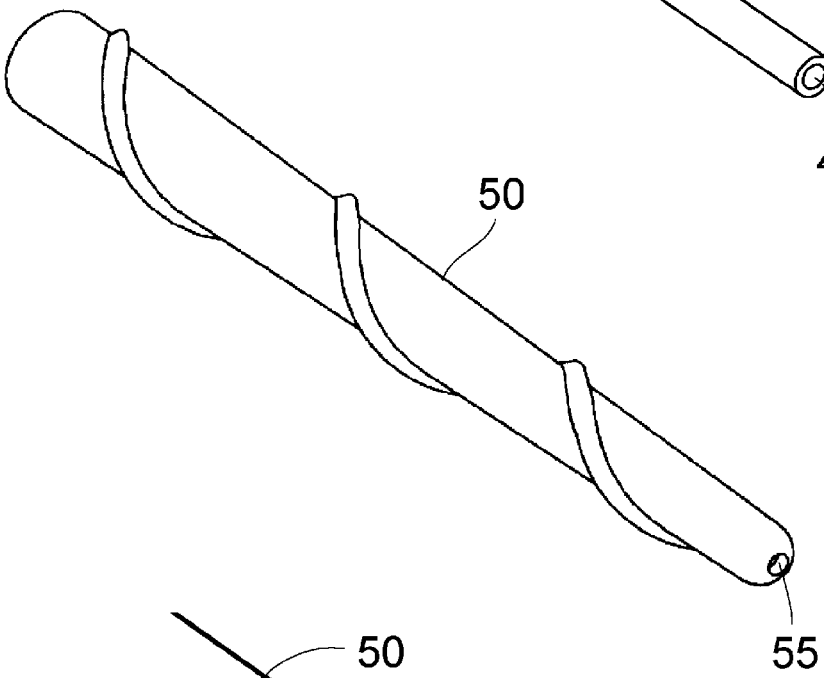

After the inner resin molded portion 40 is formed in the first molding step, the outer resin molded portion 50 which covers the outside of the inner resin molded portion 40 as shown in FIGS. 2(C), 2(D), and 7(B) is formed in the second molding step. That is, a structure 46 in which the inner resin molded portion 40 is disposed as shown in FIGS. 2(A) and 7(A) is placed in the molding space of the second resin molding die (however, the basal end side of the connection metal fitting 20 is outside the molding space), the base end of the connection metal fitting 20 is supported, and a molten resin is poured into the molding space in the state where a mold pin for fixation is inserted into the inside of the columnar recess portion 45 to support the columnar recess portion 45, thereby performing the insert molding. As a result, the outer resin molded portion 50 can be molded in the state where occurrence of elongation by the molding pressure or deformation due to buckling is suppressed, and the structure 46 is positioned at the center of the molding space.

Figure 7C:
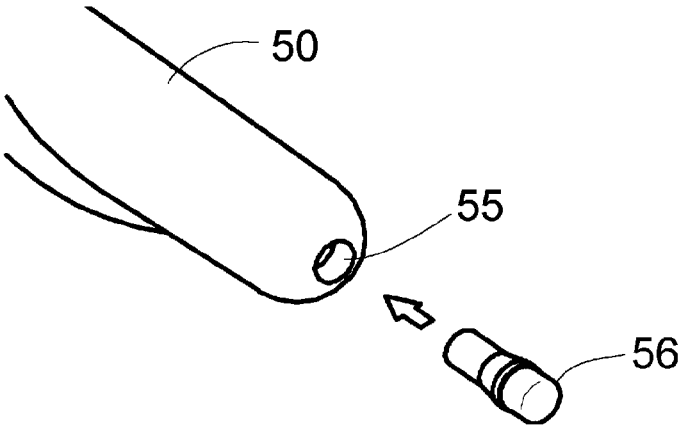

The outer resin molded portion 50 which is formed in the second molding step covers the outside of the inner resin molded portion 40, and is softer (configured by a soft material) than the inner resin molded portion 40. This configuration is employed in order to reduce impact which may be caused when an article is contacted with the antenna. As shown in FIG. 7(C), after the second molding step, a hole portion 55 which passes through the tip end portion of the outer resin molded portion 50 to reach a predetermined depth of the tip end portion of the inner resin molded portion 40 (which passes through the tip end portion of the outer resin molded portion 50 to reach the columnar recess portion 45) remains. When a resin-made cap 56 is fitted to the hole portion 55 to close the hole portion 55, therefore, a composite antenna which can operate both in the frequency band for AM/FM broadcasts and the TEL band which is higher than the frequency band for AM/FM broadcasts is obtained. In the attachment of the cap 56, an adhesive agent or the like may be used in combination with the cap.

According to the composite antenna in Embodiment 1, with respect to the frequency band for AM/FM broadcasts, the whole series connection structure of the coil element 1 which serves as the first antenna element, and the cylindrical conductive element 10 which serves as the second antenna element functions as an antenna element.

In the TEL band, furthermore, the trap coil portion 3 of the coil element 1 has a high impedance, and functions so as to separate the coil element 1 from the cylindrical conductive element 10. Therefore, the cylindrical conductive element 10 functions as an antenna element. In this case, the outer diameter of the cylindrical conductive element 10 can be increased, and therefore the bandwidth can be broadened.

According to the embodiment, it is possible to attain the following effects.

(1) The composite antenna has the structure in which the cylindrical conductive element 10 (functioning as the second antenna element) is electrically series-connected to the base end side of the coil element 1 (functioning as the first antenna element), and is set so that the series connection of the coil element 1 and the cylindrical conductive element 10 operates in the frequency band for AM/FM broadcasts which is the first frequency band, and the cylindrical conductive element 10 alone operates in the TEL band which serves as the second frequency band that is higher than the frequency band for AM/FM broadcasts. In the structure, the outer diameter of the cylindrical conductive element 10 is not limited by the inner diameter of the coil element 1. Therefore, the outer diameter of the cylindrical conductive element 10 can be made sufficiently larger than that of the coil element 1 without increasing the diameter dimension of the antenna exterior as compared with a conventional AM/FM antenna, and the bandwidth of the TEL band can be broadened.

(2) The cylindrical conductive element 10 can be produced by sheet metal working of a metal plate such as a tin plate, and easily and economically produced.

(3) In a structure where a coil element is held by conventional resin molding using a molding die, there is a case where the coil pitch is caused to deviate by the molding pressure of a resin, it is difficult to stably hold the coil element in a small-pitch zone such as the trap coil portion 3, and there is a possibility of a short-circuit between coil pitches. In the embodiment, in order to stably hold the trap coil portion 3 of a small pitch in which there is a possibility of a short-circuit between coil pitches, the spiral groove 32 of the insulative core member 30 is screwed (engaged) with the trap coil portion 3, and therefore the inner resin molded portion 40 can be insert-molded in the state where the coil pitch intervals are held constant.

(4) The composite antenna has the inner resin molded portion 40 which covers the coil element 1 and the cylindrical conductive element 10, and the outer resin molded portion 50 which is softer than the inner resin molded portion 40, and which covers the outside of the inner resin molded portion 40. Therefore, a shock which may be caused when an article is contacted with the antenna can be mitigated.

(5) In the second molding step, the outer resin molded portion 50 is molded by pouring a molten resin into the molding space in the state where the structure 46 in which the inner resin molded portion 40 is disposed is placed in the molding space of the second resin molding die, the base end of the connection metal fitting 20 is supported, and the mold pin for fixation is inserted into the inside of the columnar recess portion 45. Therefore, occurrence of elongation by the molding pressure or deformation due to buckling can be suppressed, and the outer resin molded portion 50 can be molded in the state where the structure 46 is positioned at the center of the molding space. When the resin-made cap 56 is fitted to and close the hole portion 55 which remains in the tip end portion of the outer resin molded portion 5, furthermore, the appearance can be maintained to be satisfactory.

(6) When the cutout portion 13 is formed in the base end portion of the cylindrical conductive element 10, the connecting portion 21 of the connection metal fitting 20 is exposed from the cutout portion 13 in the case where the connection metal fitting 20 is fitted and resistance-welded to the base end portion. Therefore, the resistance-welding work can be stably performed.

(7) Since the inner resin molded portion 40 has the thick portion 42 which circles in a strip-like manner the outside of the base end portion of the cylindrical conductive element 10, moreover, it is possible to reinforce the base end portion of the conductive element 10 in which the strength is lowered by the formation of the cutout portion 13.

(8) The through holes 12 are formed in the outer circumferential surface of the cylindrical conductive element 10, and the inner resin molded portion 40 passes through the through holes 12 to form the projections 41 on the outer circumference of the conductive element 10. Therefore, the conductive element 10 and the inner resin molded portion 40 can be integrally rotated without causing positional displacement.

Embodiment 2

Figure 8:
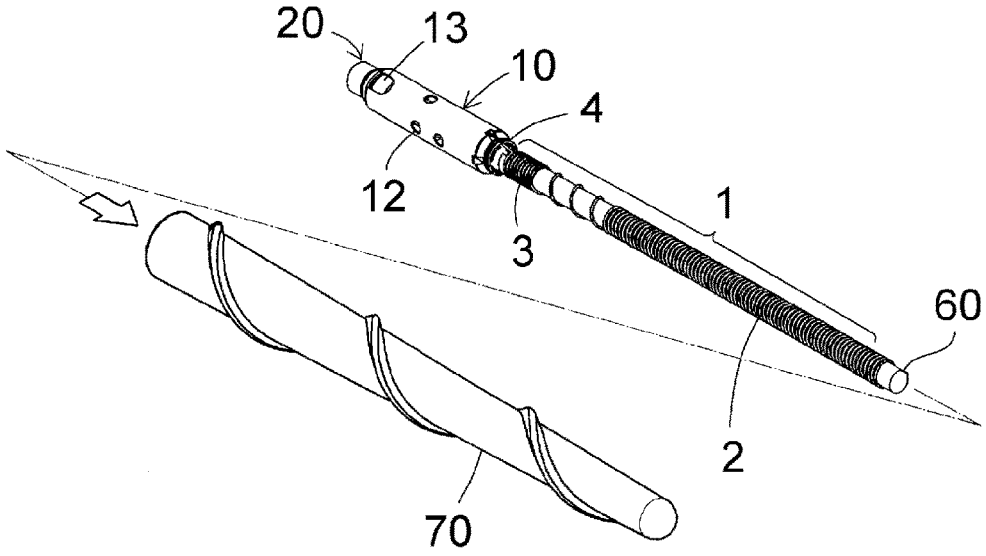
FIG. 8 is an exploded perspective view showing Embodiment 2 according to the present invention.

Embodiment 2 regarding the composite antenna and the method of producing the same according to the present invention will be described with reference to FIG. 8. In the above-described Embodiment 1, the inner resin molded portion 40 and the outer resin molded portion 50 are formed by insert-molding in the first and second molding steps. In Embodiment 2, in place of the formation of the inner resin molded portion 40 and the outer resin molded portion 50 by insert-molding, by contrast, an insulative core member 60 is caused to project from the tip end of the cylindrical conductive element 10 so as to be slightly longer than the whole length of the coil element 1, the coil element 1 is wound around the outer circumferential surface of the insulative core member 60, and fixed thereto by adhesion, and another outer insulator 70 is put on the coil element 1 and the cylindrical conductive element 10 so as to cover them, and adhesively fixed to the outer circumferential surface of the conductive element 10. Preferably, the outer insulator 70 is made of a soft resin which is similar to the outer resin molded portion 50. The other configuration may be identical with that of Embodiment 1.

Also in Embodiment 2, the outer diameter of the cylindrical conductive element 10 can be made sufficiently larger than the outer diameter of the coil element 1 without increasing the diameter dimension of the antenna exterior as compared with a conventional AM/FM antenna, and the bandwidth of the TEL band can be broadened. Since the coil element 1 is wound and adhered to the outer circumferential surface of the insulative core member 60, the coil pitch can be prevented from being changed.

Although the present invention has been described with reference to the embodiments, it is obvious to those skilled in the art that the components and processing processes in the embodiments can be variously modified within the scope of the claims. Hereinafter, modifications will be described.

In the embodiments, for the sake of convenience in resistance-welding of the cylindrical conductive element 10 and the connection metal fitting 20, the cutout portion 13 is disposed in the base end of the cylindrical conductive element 10. Alternatively, a window-like structure which does not reach the edge of the base end of the conductive element 10 may be employed as the cutout portion 13.

Moreover, a structure where the cylindrical conductive element 10 and the connection metal fitting 20 are electrically connected and mechanically secured to each other by means other than resistance-welding may be employed.

In the embodiments, the connection metal fitting 20 to which the insulative core member 30 or 60 is provisionally fixed is secured to the cylindrical conductive element 10. Alternatively, a structure where the insulative core member 30 or 60 is directly positioned and fixed to the cylindrical conductive element 10 may be employed.

Although, in the embodiments, the cylindrical conductive element 10 is used as the second antenna element, a tubular conductive element having a shape which is other than a cylindrical shape, such as a rectangular tubular shape may be used. Also in this case, the bandwidth of the used frequency band can be broadened.

REFERENCE SIGNS LIST

1 coil element, 2 helical coil portion, 3 trap coil portion, 4 connecting portion, 10 cylindrical conductive element, 11 coil attaching portion, 12 through hole, 13 cutout portion, 20 connection metal fitting, 21 connecting portion, 22 press insertion hole, 23 male thread portion, 30, 60 insulative core member, 31 attachment portion, 32 spiral groove, 33 screwing portion, 34, 35, 41, 44 projection, 40 inner resin molded portion, thick portion, 43 reinforcement rib, 45 columnar recess portion, 46 structure, 50 outer resin molded portion, 70 outer insulator

The invention claimed is:

1. A composite antenna comprising:

a coil element which is formed into a spiral shape, and which has a trap coil portion in a base end portion;

a tubular conductive element which is electrically series-connected to a base end of the coil element; and a connection metal fitting which is electrically connected to a base end of the conductive element, wherein a series connection of the coil element and the tubular conductive element operates in a first frequency band, and the tubular conductive element alone operates in a second frequency band which is higher than the first frequency band.

2. The composite antenna according to claim 1, further comprising an insulative core member which is placed inside the conductive element, and which has a spiral groove in a tip end side that projects from the conductive element, wherein the trap coil portion is engaged with the spiral groove to hold a pitch of the trap coil portion constant.

3. The composite antenna according to claim 1, further comprising: an inner resin molded portion which holds the coil element and the conductive element; and an outer resin molded portion which is softer than the inner resin molded portion, and which covers an outside of the inner resin molded portion.

4. The composite antenna according to claim 3, wherein a hole portion which passes through a tip end portion of the outer resin molded portion to reach a predetermined depth of a tip end portion of the inner resin molded portion is formed, and a cap is fitted to the hole portion.

5. The composite antenna according to claim 3, wherein a cutout portion is formed in the base end portion of the conductive element, and a thick portion which circles in a strip-like manner an outside of the base end portion of the conductive element is formed on the inner resin molded portion.

6. The composite antenna according to claim 3, wherein a through hole is formed in an outer circumferential surface of the conductive element, and the inner resin molded portion passes through the through hole.

7. The composite antenna according to claim 1, further comprising an insulative core member which is placed inside the conductive element, and which projects from the conductive element, wherein the coil element is adhered to an outer circumference of the insulative core member, and the coil element and the conductive element are covered by an outer insulator.

* * * * *